US011505375B2

(12) United States Patent
Paganuzzi

(10) Patent No.: US 11,505,375 B2
(45) Date of Patent: Nov. 22, 2022

(54) CLOSURE OF A CONTAINER

(71) Applicant: BORMIOLI PHARMA S.P.A., Milan (IT)

(72) Inventor: Valerio Paganuzzi, Parma (IT)

(73) Assignee: BORMIOLI PHARMA S.P.A., Milan (IT)

( * ) Notice: Subject to any disclaimer, the term of this patent is extended or adjusted under 35 U.S.C. 154(b) by 253 days.

(21) Appl. No.: 16/967,308

(22) PCT Filed: Jan. 24, 2019

(86) PCT No.: PCT/IB2019/050588
§ 371 (c)(1),
(2) Date: Aug. 4, 2020

(87) PCT Pub. No.: WO2019/155314
PCT Pub. Date: Aug. 15, 2019

(65) Prior Publication Data

US 2021/0031991 A1 Feb. 4, 2021

(30) Foreign Application Priority Data

Feb. 8, 2018 (IT) ..... 102018000002519

(51) Int. Cl.
*B65D 51/28* (2006.01)
*B65D 41/04* (2006.01)
*B65D 50/04* (2006.01)

(52) U.S. Cl.
CPC ..... *B65D 51/285* (2013.01); *B65D 41/04* (2013.01); *B65D 50/041* (2013.01)

(58) Field of Classification Search
CPC .... B65D 2585/56; B65D 51/28; B65D 51/26; B65D 47/148; B65D 47/0885;
(Continued)

(56) References Cited

U.S. PATENT DOCUMENTS 2,073,273 A * 3/1937 Korn ..... B01F 23/23611 426/477
3,840,136 A * 10/1974 Lanfranconi ..... B65D 51/226 222/83.5

(Continued)

FOREIGN PATENT DOCUMENTS

DE 3300347 A1 7/1984
EP 0393340 A1 10/1990

(Continued)

*Primary Examiner* — Ernesto A Grano
(74) *Attorney, Agent, or Firm* — Pearne & Gordon LLP

(57) ABSTRACT

A closure of a container comprising a capsule (10) in turn comprising: —a cap (2) that can be associated with a container and comprising a frangible mouth (20); —a cutter (3) comprising a cutting edge (30) designed to open said frangible mouth (20); —a covering (4) of the cutter (3); —transmission means (50) for transmitting a rotary component of a movement of the covering (4) to the cutter (3); —guide means (900) which enable a rotation-translation of the covering (4) which draws said cutter (3), determining the passage of the covering (4) and the cutter (3) from a resting configuration in which the frangible mouth (20) is intact to an operating configuration in which the cutter (3) is in a stroke-end position, the frangible mouth (20) is at least partially open and the covering (4) is rotatingly integral with the cap (2). The closure (1) further comprises: i) a capsule cover (11) which surmounts the covering (4); the covering (4) and the capsule cover (11) in a first configuration being axially neared to one another along an axial direction (40), in a second configuration being moved away from one another along the axial direction (40); the axial direction (40) being identified by an axis (300) along which the movement of the cutter (3) from the resting configuration to the operating configuration takes place; ii) disengageable means (6) for transmitting an unscrewing torque from the capsule cover (11) to the covering (4), said disengageable
(Continued)

means (6) for the unscrewing of the capsule (10) being mutually engaged in the first configuration and mutually disengaged in the second configuration.

7 Claims, 2 Drawing Sheets

(58) Field of Classification Search
CPC ..... B65D 23/00; B65D 51/285; B65D 51/30; B65D 2401/25; B65D 51/20; B65D 2401/15; B65D 2401/20; B65D 41/04; B65D 50/041
USPC ..... 215/257; 220/212
See application file for complete search history.

(56) References Cited

U.S. PATENT DOCUMENTS 4,982,875 A * 1/1991 Pozzi ..... B65D 81/3222 604/416
5,316,161 A 5/1994 Gargione
5,927,549 A * 7/1999 Wood ..... B65D 51/285 222/129
6,148,996 A * 11/2000 Morini ..... B65D 51/285 215/DIG. 8
6,705,462 B2 * 3/2004 Kasuya ..... B65D 25/08 215/DIG. 8
8,215,481 B1 * 7/2012 Knickerbocker .... B65D 51/285 215/DIG. 8
2002/0020636 A1 * 2/2002 Bergamini ..... A61J 1/2093 206/219
2005/0161348 A1 * 7/2005 Morini ..... B65D 51/285 206/219
2006/0108314 A1 * 5/2006 Cho ..... B65D 51/285 215/253
2008/0093326 A1 * 4/2008 Cho ..... B65D 51/285 206/222
2008/0142473 A1 * 6/2008 Cho ..... B65D 51/285 215/329
2008/0202949 A1 * 8/2008 Morini ..... B65D 51/285 206/219
2010/0059394 A1 * 3/2010 Fontana ..... B65D 81/3222 206/219
2010/0116699 A1 * 5/2010 Sorenson ..... B65D 51/285 206/219
2010/0282624 A1 * 11/2010 Paganuzzi ..... B65D 51/285 206/222
2011/0147414 A1 * 6/2011 Chen ..... B65D 51/285 222/83
2012/0325697 A1 * 12/2012 Cho ..... B65D 51/285 206/219
2013/0105433 A1 * 5/2013 Chen ..... B65D 51/2835 29/434
2013/0313138 A1 * 11/2013 Thoman ..... B65D 51/285 206/222
2014/0017363 A1 * 1/2014 Aibe ..... A23L 29/231 426/115
2014/0048507 A1 * 2/2014 Brambilla ..... B65D 51/30 215/257
2015/0203261 A1 * 7/2015 Lee ..... B65D 1/0246 206/219
2015/0239638 A1 * 8/2015 Lee ..... B65D 39/08 206/219
2016/0264323 A1 * 9/2016 Jeon ..... B65D 51/243
2018/0208372 A1 * 7/2018 Rovelli ..... B65D 51/285
2018/0362229 A1 12/2018 Paganuzzi

FOREIGN PATENT DOCUMENTS

WO 2008123750 A2 10/2008
WO 2017109599 A1 6/2017

* cited by examiner

CLOSURE OF A CONTAINER

TECHNICAL FIELD

The present invention relates to a closure of a container.

BACKGROUND ART

There are known closures of the type described in the patent WO2017/109599. This closure comprises:

a cap which closes a mouth of a container and comprises a frangible base;

a cutter intended to open said frangible mouth; the cutter is hollow and in combination with the frangible mouth defines a tank that receives in its interior a solute intended to dissolve in the solvent present in the container;

a covering that protects both said capsule and said cutter and comprises a security strip that must be removed in order to break the frangible base, mixing the solute and solvent. The covering makes it possible to avoid a user managing to unscrew the cap without first having broken the frangible mouth through the cutter. After having removed the security strip, the initial screwing of the covering onto the cap pushes the cutter, causing the opening of the frangible mouth. A subsequent unscrewing of the covering allows the removal of the cutter and the cap, allowing the dispensing of the product placed in the container.

A drawback of this constructive solution is linked to the fact that the covering is directly reachable by a child who could then be able to open the closure, accessing the contents. Typically containers of this type are used for containing drugs or other products for which overdosing should be avoided.

DISCLOSURE OF THE INVENTION

The object of the present invention is to propose a closure of a container and a method of opening the closure which overcome the above-illustrated drawbacks.

The technical task set and the objects specified are substantially attained by a closure of a container and opening method of the closure comprising the technical characteristics as set out in one or more of the accompanying claims.

BRIEF DESCRIPTION OF DRAWINGS

Further characteristics and advantages of the present invention will become more apparent from the following indicative and therefore non-limiting description of a closure of a container as illustrated in the appended drawings, in which.

DETAILED DESCRIPTION OF PREFERRED EMBODIMENTS OF THE INVENTION

Figure 1:
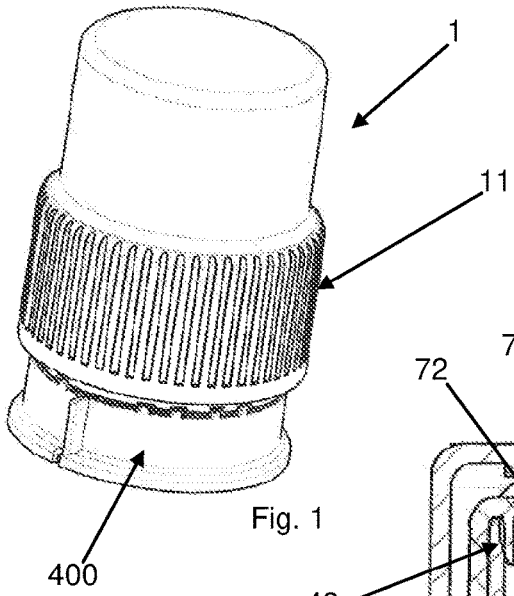
FIG. 1 shows a perspective view of a closure according to the present invention.

In the appended figures, reference number 1 denotes a closure of a container.

The closure 1 suitably comprises a capsule 10.

This capsule in turn 10 comprises a cap 2 that can be associated with a container. The cap 2 comprises a frangible mouth 20.

In particular, the cap 2 can be associated with a mouth of the container. In this regard the cap 2 comprises an inner annular surface comprising a threading 21 suitable to interact with a corresponding threading fashioned on the container. The cap 2 suitably comprises an annular seat 32 designed to receive an end of the mouth of the container.

The capsule 10 further comprises a cutter 3. The cutter 3 comprises a cutting edge 30 designed to open said frangible mouth 20.

The capsule 10 further comprises a covering 4 of the cutter 3.

Suitably both the covering 4 and the cutter 3 are made of plastic.

The covering 4 suitably comprises a security strip 400. The security strip 400 must be removed to allow the opening of the container closed by the capsule 1.

The capsule 10 further comprises transmission means 50 for transmitting a rotary component of a movement of the covering 4 to the cutter 3. The transmission means 50 are toothed.

The transmission means 50 are partly fashioned on a surface of the covering 4 (suitably turned inwards) and partly fashioned on a surface of the cutter 3 (suitably turned outwards) which mutually face each other. The transmission means 50 mutually interact with each other and are thus rigidly coupled to the rotation of said cutter 3 and the covering 4.

The capsule 10 comprises guide means 900 which enable a rotation-translation of the covering 4 which draws said cutter 3, determining the passage of the covering 4 and the cutter 3 from a resting configuration to an operating configuration.

Figure 2:
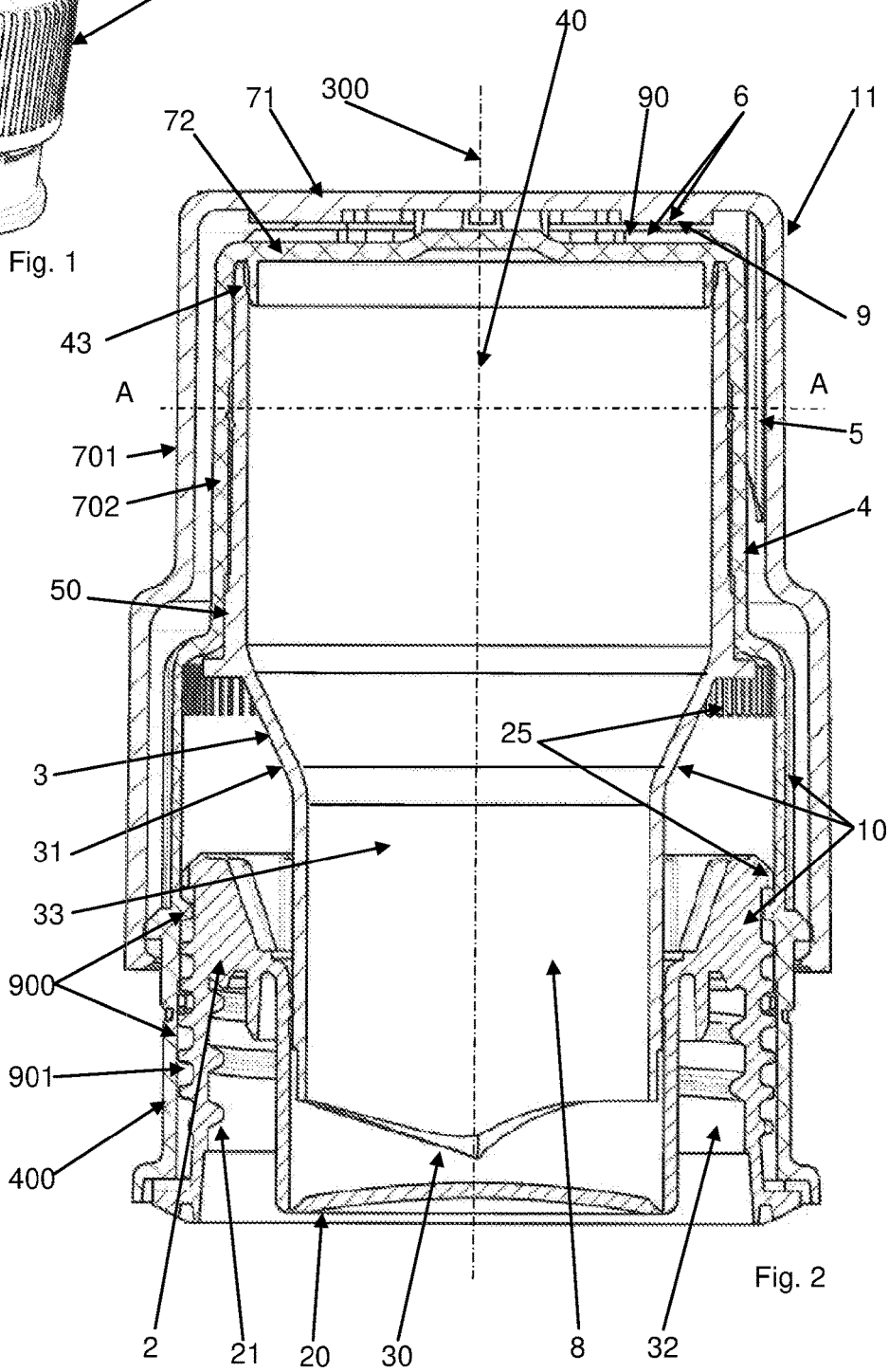
FIG. 2 shows a sectional view of the closure of FIG. 1.
Figure 3:
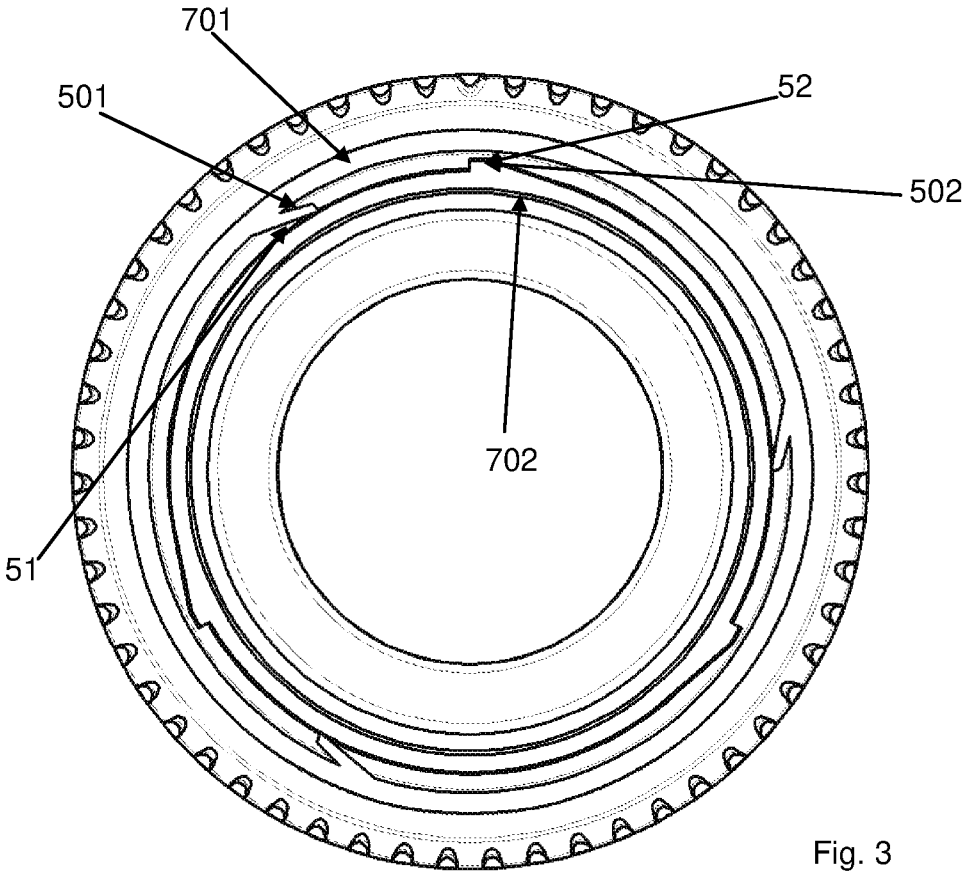
FIG. 3 shows a sectional view along the plane AA of FIG. 2.

In the resting configuration, the cutter 3 is in a start-stroke position and the frangible mouth 20 is intact (this is the situation illustrated in FIG. 2). In the operating configuration the cutter 3 is in an end-stroke position, the frangible mouth 20 is at least partly open and the covering 4 is rotatingly integral with the cap 2. In the resting configuration at least the cap 2 and the cutter 3 define a containing tank 8 for containing a product which is designed to be located in the container in the operating configuration (dropping from the opening of the frangible mouth 20 by gravity).

In the operating configuration the covering 4 is rotatingly integral with the cap 2 by toothed gear means 25 fashioned on the cap 2 and on the covering 4. In fact in the resting configuration they are spaced apart while in the operating configuration they face each other, mutually meshing.

The product in the tank 8 is advantageously powdered or granular material. This product is a solute intended to dissolve in a substance (solvent) contained in the container. The cutter 3 and the covering 4 are physically distinct pieces. Advantageously the cutter 3 is a single piece. The cutter 3 is a body that defines a cavity 33 inside in which it is possible to house at least one part of the product (solute). Similarly the cap 2 is a single piece.

The closure 1 also comprises a capsule cover 11 that surmounts the covering 4. The covering 4 and the capsule cover 11 in a first configuration are axially neared to one another along an axial direction 40. In a second configuration they are moved away from one another along the axial direction 40. The axial direction 40 is identified by an axis 300 along which the movement of the cutter 3 from the resting configuration to the operating configuration takes place.

Advantageously the cutter 3 also comprises a widening zone 31, wherein, as it moves away from the cutting edge 30, the transversal section of the cutter 3 increases (and therefore the transversal section of the tank 8). This "transversal" section is evaluated with respect to an axial direction of screwing of the covering 4 on the cap 2. In particular, there is a widening of the section of the cutter 3 which is orthogonal to the axial direction of screwing of the covering 4 on the cap 2. As shown by way of example in the appended figures, the widening area 30 is a countersink.

This widening zone 30 makes it so the tank 8 cannot be delimited at the top by the cutter 3 due to problems related to the fact that such a piece is made by moulding. The covering 4 and cutter 3 are however in direct contact to minimise the possible deterioration of the solute present in the tank 8 caused by moisture.

In this regard the covering 4 defines an annular groove 43 into which one end of the cutter 3 is inserted that is located on the opposite side with respect to the cutting edge 30.

The passage from the resting configuration to the operating configuration is associated with a cutting of the frangible mouth 20 that defines an arc of circumference that subtends an angle at the centre comprised between 250° and 300°, in particular comprised between 260° and 280°. This makes it possible to cut the frangible mouth 20 without running the risk that the same can fall inside the container (and would in fact prevent the subsequent extraction of the product present in the container). In this regard, one end of the cutter 3 comprises a circular perimeter and the cutting edge 30 involves less than 25% of said perimeter; the remaining parts of the perimeter extend along a same imaginary plane (which is suitably orthogonal to the line of movement of the cutter 3).

The closure 1 suitably comprises disengageable means 6 for transmitting an unscrewing torque from the capsule cover 11 to the covering 4. The unscrewing torque, in a configuration wherein the covering 4 and the cap 2 are integral with each other, allows the unscrewing of the capsule 10 from the container. In fact in this case the gear means 25 are operatively connected and the unscrewing torque determines the unscrewing of the cap 2 from the container by means of the threading 21. This makes is possible to open the closure 1 like a normal cap once the product present in the tank 8 inside the container has been released. The disengageable means 6 are afforded partly on the capsule 10 and partly on the capsule cover 11. The disengageable means 6 for unscrewing the capsule 10 are mutually engaged in the first configuration and mutually disengaged in the second configuration. In this way in order to allow the unscrewing of the cap 2 and therefore access to the product, a movement is required which envisages a compression and a joint rotation of the capsule cover 11, an operation which has proved to be very complex for young children. In this sense the closure 1 can therefore be defined as "child proof".

The capsule cover 11 and covering 4 respectively comprise:

a first and a second base 71, 72 that are facing one another;

a first and a second lateral wall 701, 702 that are facing one another and which extend respectively from said first and from said second base 71, 72.

Suitably the disengageable means 6 for transmitting an unscrewing torque are fashioned partly in the first base 71 and partly in the second base 72. The disengageable means 6 for transmitting an unscrewing torque comprise at least one tooth 9 which in the second configuration is inserted in a corresponding housing 90. The tooth 9 and the housing 90 are fashioned one on the first base 71 and one on the second base 72.

Advantageously there is a plurality of teeth which engage in corresponding housings. Preferably the teeth extend radially.

The closure 1 can also comprise transmission means 5 for transmitting a torque from the capsule cover 11 to the capsule 10 which determines the above-described rotation-translation of the covering 4 and of the cutter 3 and the passage from the resting configuration to the operating configuration. In an alternative, non-preferred solution the means 5 could be absent and in this case the disengageable means 6 could be used not only to transmit the unscrewing torque, but also to perform the passage from the resting configuration to the operating configuration.

The transmission means 5 for transmitting a torque from the capsule cover to the capsule which determines the rotation-translation of the covering 4 and of the cutter 3 comprise first and second abutments 51, 52 which are fashioned respectively in said first lateral wall and partly in said second lateral wall 701, 702. The first abutments 51 comprise first tabs 501 that extend towards the inside of the first lateral wall 701; the second abutments 52 comprise second tabs 502 that extend towards the outside of the second lateral wall 702.

A first rotation direction of the capsule cover 11 with respect to the covering 4 determines the mutual enmeshing of the first and second abutments 51, 52; a second direction of rotation, opposite the first, determines a mutual sliding of the first and second abutments 51, 52 (the sliding ensures that no torque is transmitted). The first rotation direction will thus allow the transmission of the torque to the covering 4 and the screwing of the covering 4 along the cap 2 (with the passage from the resting configuration to the operating configuration). The second rotation direction does not produce a movement of the covering 4. Typically a chattering noise is produced, generated by the sliding of the first tabs 501 on the second tabs 502.

The guide means 900 comprise threaded connection means 901 which couple the covering 4 and the cap 2, enabling a rotation-translation of the covering 4 and of the cutter 3 with respect to said cap 2, passing from the resting configuration to the operating configuration. The means 901 as exemplified in FIG. 2 are fashioned on the cap 2.

A further object of the present invention is an opening method of a closure 1 having one or more of the characteristics described hereinabove.

The method conveniently comprises the steps of:

rotating the capsule cover 11 in a first direction by drawing the covering 4 and the cutter 3 in rotation-translation, which in this way carry out a stroke at the end of which there is an enmeshing of the covering 4 and the cap 2; during said stroke the cutter 3 determines the opening of the frangible mouth 20 and the drop of the product present in the tank 8 inside the container;

pushing the capsule cover 11 towards the capsule 10 and rotating the capsule cover 11 in a second direction, opposite the first direction, thus determining an unscrewing of the capsule cover 11 and the capsule 10 of the container.

The present invention makes it possible to minimise the risk that children are able to access the contents of a container.

The invention as it is conceived is susceptible to numerous modifications and variations, all falling within the scope of the inventive concept characterising it. Furthermore, all the details can be replaced with other technically-equivalent elements. In practice, all the materials used, as well as the dimensions, can be any according to requirements.

The invention claimed is:

1. A closure of a container comprising a capsule (10) in turn comprising:

a cap (2) that can be associated with a container and comprising a frangible mouth (20);

a cutter (3) comprising a cutting edge (30) designed to open said frangible mouth (20);

a covering (4) of the cutter (3);

transmission means (50) for transmitting a rotary component of a movement of the covering (4) to the cutter (3);

guide means (900) which enable a rotation-translation of the covering (4) which draws said cutter (3), determining the passage of the covering (4) and the cutter (3) from a resting configuration in which the frangible mouth (20) is intact to an operating configuration in which the cutter (3) is in an stroke end position, the frangible mouth (20) is at least partly open and the covering (4) is rotatingly integral with the cap (2); in the resting configuration at least the cap (2) and the cutter (3) defining a containing tank (8) for containing a product which is designed to be located in the container in said operating configuration;

wherein the closure comprises:

i) a capsule cover (11) which surmounts the covering (4); the covering (4) and the capsule cover (11) in a first configuration being axially neared to one another along an axial direction (40), and in a second configuration being moved away from one another along the axial direction (40); the axial direction (40) being identified by an axis (300) along which the movement of the cutter (3) from the resting configuration to the operating configuration takes place;

ii) disengageable means (6) for transmitting an unscrewing torque from the capsule cover (11) to the covering (4), said unscrewing torque, in a configuration in which the covering (4) and the cap (2) are integral with each other, allowing the unscrewing of the capsule (10) from the container; said disengageable means (6) being afforded partly on the capsule (10) and partly on the capsule cover (11); said disengageable means (6) for the unscrewing of the capsule (10) being mutually engaged in the first configuration and mutually disengaged in the second configuration;

iii) transmission means (5) for transmitting a torque from the capsule cover (11) to the capsule (10) which determines a rotation-translation of the covering (4) and of the cutter (3) and the passage from the resting configuration to the operating configuration;

said capsule cover (11) and said covering (4) respectively comprising:

a first and a second base (71, 72) that are facing one another;

a first and a second lateral wall (701, 702) that are facing one another and which extend respectively from said first and from said second base (71, 72);

the transmission means (5) for transmitting a torque from the capsule cover to the capsule which determines a rotation-translation of the covering and of the cutter comprise first and second abutments (51, 52) which are fashioned respectively in said first lateral wall and partly in said second lateral wall (701, 702); a first rotation direction of the capsule cover (10) with respect to the covering (4) determining the reciprocal enmeshing of the first and second abutments (51, 52); a second rotation direction, opposite the first rotation direction, determining a reciprocal sliding of the first and second abutments (51, 52).

2. The closure according to claim 1, characterised in that the cutter (3) also comprises a widening zone (31), wherein, as it moves away from the cutting edge (30), the transversal section of the cutter (3) increases.

3. The closure according to claim 1, characterised in that the disengageable means (6) for transmitting an unscrewing torque are fashioned partly in the first base (71) and partly in the second base (72).

4. The closure according to claim 1, characterised in that the disengageable means (6) for transmitting an unscrewing torque comprise at least a tooth (9) which in the second configuration is inserted in a corresponding housing (90), said tooth (9) and said housing (90) being fashioned one on the first base (71) and one on the second base (72).

5. The closure according to claim 1, characterised in that the guide means (900) comprise threaded connection means (901) which couple the covering (4) and the cap (2), enabling a rotation-translation of the covering (4) and of the cutter (3) with respect to said cap (2), passing from the resting configuration to the operating configuration.

6. The closure according to claim 1, characterised in that the cap (2) comprises a threading (21) for connection with the container.

7. A method for opening a closure according to claim 1, characterised in that it comprises the steps of:

rotating the capsule cover (11) in a first direction drawing the covering (4) and the cutter (3) in rotation-translation which in this way carry out a stroke at the end of which there is an enmeshing of the covering (4) and of the cap (2); during said stroke the cutter (3) determining the opening of the frangible mouth (20) and the drop of the product present in the tank (8) internally of the container;

pushing the capsule cover (11) towards the capsule (10) and rotating the capsule cover (11) in a second direction, opposite the first direction, thus determining an unscrewing of the capsule cover (11) and of the capsule (10) from the container.

* * * * *